United States Patent [19]

Fujikura et al.

[11] 4,055,448

[45] Oct. 25, 1977

[54] FERRITE-AUSTENITE STAINLESS STEEL

[75] Inventors: Masakuni Fujikura, Nagoya; Naohiro Abe, Chita, both of Japan

[73] Assignee: Daido Seiko Kabushiki Kaisha, Nagoya, Japan

[21] Appl. No.: 686,598

[22] Filed: May 14, 1976

Related U.S. Application Data

[63] Continuation-in-part of Ser. No. 459,364, April 9, 1974, abandoned.

[30] Foreign Application Priority Data

| | | |
|---|---|---|
| Apr. 10, 1973 | Japan | 48-40607 |
| Jan. 29, 1974 | Japan | 49-12405 |

[51] Int. Cl.[2] ..... C22C 38/42

[52] U.S. Cl. ..... 148/38; 75/125; 75/128 A; 75/128 F; 75/128 G; 75/128 N; 75/128 Z; 75/128 T; 75/128 W

[58] Field of Search ..... 75/124, 125, 128 A, 75/128 F, 128 G, 128 N, 128 Z, 128 T, 128 W; 148/38, 37

[56] References Cited

U.S. PATENT DOCUMENTS

| | | | |
|---|---|---|---|
| 2,750,283 | 6/1956 | Loveless | 75/124 |
| 3,306,736 | 2/1967 | Rundell | 75/128 F |
| 3,352,666 | 11/1967 | Foster | 75/128 F |
| 3,499,802 | 3/1970 | Lagneborg | 75/128 W |
| 3,567,434 | 3/1971 | Richardson et al. | 75/125 |
| 3,740,213 | 6/1973 | Hellner et al. | 75/128 G |
| 3,785,787 | 1/1974 | Yokota et al. | 75/125 X |
| 3,795,507 | 3/1974 | Allen | 75/124 |
| 3,856,515 | 12/1974 | Brandis et al. | 75/126 C |
| 3,865,644 | 2/1975 | Hellner et al. | 75/124 |
| 3,926,685 | 12/1975 | Gueussier et al. | 148/37 X |

*Primary Examiner*—Arthur J. Steiner

[57] ABSTRACT

Disclosed is an improved stainless steel in ferrite-austenite condition caused by solution heat treatment at a temperature of 1000° - 1150° C, composed of by weight percent, carbon up to 0.06%, silicon up to 1.0%, manganese up to 1.5%, nickel from 3.0% to 7.0%, chromium from 21.0% to 28.0%, copper up to 3.0%, molybdenum from 1.0% to 4.0%, boron from 0.0008% to 0.0080%, niobium from 0.08% to 0.7%, titanium from 0% to 0.5%, tantalum from 0% to 0.5%, zirconium from 0% to 0.5%, nitrogen up to 0.1%, and the remainder of iron and an inevitable amount of impurity, with the values of nickel equivalent and chromium equivalent calculated by the following equations:

nickel equivalent = 40(carbon % + nitrogen %) + 3(nickel %) + (copper %) + 2(manganese %)

chromium equivalent = (chromium %) + 5.2(silicon %) + 4.2(molybdenum %) + 4.5(niobium %) + 7.0(titanium %) + 3.0(tantalum %) + 13.0(zirconium %)

satisfying the relationship below:

nickel equivalent = from 15 to 30 chromium equivalent = from 28 to 50 chromium equivalent — nickel equivalent = from 8 to 27.

3 Claims, 8 Drawing Figures

FERRITE-AUSTENITE STAINLESS STEEL

This application is a continuation-in-part of U.S. application Ser. No. 459,364, filed Apr. 9, 1974 now abandoned.

BRIEF SUMMARY OF INVENTION

This invention relates to an improved ferrite-austenite stainless steel, and more particularly an improved ferrite-austenite stainless steel having high proofstress, enhanced corrosion resistance and excellent workability, the ferrite-austenite phase of said stainless steel being caused by a heat solution treatment in the temperature range of 1000° - 1150° C.

AISI 304 (18 Cr - 8 Ni) and AISI 316 (18 Cr - 12 Ni -2.5 Mo), well-known austenite stainless steels, have been extensively used as constructional materials for various chemical and other equipment. Although these steels have high corrosion resistance, they are inferior in their proof stress, the values of 0.2% proof-stress being at most 30 kg/mm$^2$.

On the other hand, a precippitation hardening stainless steel, such as AISI 630 (17-4 PH) or AISI 631 (17-7 PH), has a high proof stress value, i.e. more than approximately 120 kg/mm$^2$ expressed as 0.2% proof stress. The corrosion resistance of these steels is, however, considerably inferior to that of AISI 304 or AISI 316.

Thus, no stainless steel has not yet been developed which has excellent corrosion resistance and 0.2% proof stress of the order of 50 kg/mm.

SUS 329 J1 (25 Cr - 5 Ni - 2 Mo), a stainless steel with ferrite-austenite phases, has attracted public attention as a steel having good resistance to stress corrosion cracking and to sea water, because it is excellent in corrosion resistance, particularly in resistance to corrosive environments with chloride or chlorine ion, and also has a relatively high proof stress, approximately 50 kg/mm$^2$ expressed as the 0.2% proof stress value. This steel however is significantly disadvantageous in that it must be worked at a higher temperature as it has some practical problems in being worked by hot working, and further in that it has the tendency to coarsen the crystalline particles and lowers the toughness and ductility of the steel. In addition, the corrosion resistance of the steel is not sufficient and moreover it is not immune to the sensitization when subjected to the exposure in the vicinity of 600 ° C, for example, the portion of the steel which is thermally affected during welding being much degraded in the corrosion resistance. The steel further tends to be susceptible to "hot-cracking", the cracking produced during quenching step of solution heat treatment.

Under the circumstances stated above, a need has been felt for the development of a new material which is equal or even superior in corrosion resistance to conventional stainless steels such as AISI 316, while having higher proof stress of at least about 50 kg/mm$^2$, preferably higher than 60 kg/mm$^2$ in 0.2% proof stress.

It is known that the constructional materials for various kinds of chemical equipment are manufactured by a variety of methods such as centrifugal casting, machining, rolling or forging. Among these methods, hot-forging is adopted to the greatest degree, since this method is the most advantageous from the view points of the total cost for manufacturing the materials and physical properties of the materials. Accordingly, the material for making the various kinds of equipment, e.g. the rotating body of a centrifugal separator, must possess a proper degree of hot-workability.

Under the circumstances stated above, the inventors directed their attention to the fact that SUS 329 J1 has excellent corrosion resistance and relatively high proof stress, and stands as a successful example of improving hot-workability and proof stress of ferrite austenite stainless steel while retaining or even increasing corrosion resistance.

This invention was based on the discovery that the properties of stainless steel are strikingly improved when it is prepared into ferrite-austenite condition by a heat solution treatment at a temperature of 1000 to 1150 ° C and has the following composition by weight percent: carbon up to 0.06%, silicon up to 1.0%, manganese up to 1.5%, nickel from 3.0% to 7.0%, chromium from 21.0% to 28.0%, copper up to 3.0%, molybdenum from 1.0% to 4.0%, boron from 0.0008% to 0.0080%, niobium from 0.08% to 0.7%, titanium from 0% to 0.5%, tantalum from 0% to 0.5%, zirconium from 0% to 0.5%, nitrogen up to 0.1%, and the remainder of iron and an inevitable amount of impurity, with the values of nickel equivalent and chromium equivalent calculated by the following equations:

nickel equivalent = 40 (carbon % + nitrogen %) +3 (nickel %) + (copper %) +2 (manganese %)

chromium equivalent = (chromium %) + 5.2 (silicon %) +4.2 (molybdenum %) +4.5 (niobium %) +7.0 (titanium %) +3.0 (tantalum %) +13.0 (zirconium %)

satisfying the relationship below:

nickel equivalent = from 15 to 30 chromium equivalent = from 28 to 50 chromium equivalent — nickel equivalent = from 8 to 27.

It is an object of this invention to provide a ferrite-austenite stainless steel having improved corrosion resistance and excellent hot-workability along with increased proof stress.

It is another object of this invention to provide a ferrite-austenite stainless steel which can be adapted to the fabrication of a variety of chemical and other apparatus.

It is a further object of this invention to provide a ferrite-austenite stainless steel which is adaptable especially to the rotating body and the other parts of a centrifugal separator.

It is an even further object of this invention to provide a ferrite-austenite stainless steel which is suitable for use as a material for a bolt.

The steel according to this invention has high proof stress value, at least 40 kg/mm$^2$, normally higher than 60 kg/mm$^2$, expressed as 0.2% proof stress value.

The steel according to this invention has excellent corrosion resistance equal to or rather better than SUS 329 J1.

The steel according to this invention has greatly improved hot-workability compared with the conventional ferrite-austenite stainless steel.

The steel according to this invention is especially adapted for use in the rotatin body and the other parts of a centrifugal separator, and also for use as a material for fabricating appratuses having many different purposes.

The steel according to this invention is also adapted for use as a material for a bolt.

Other and further objects, features and advantages of this invention will be more fully apparent from the following description.

DETAILED DESCRIPTION OF INVENTION

Figure 1:
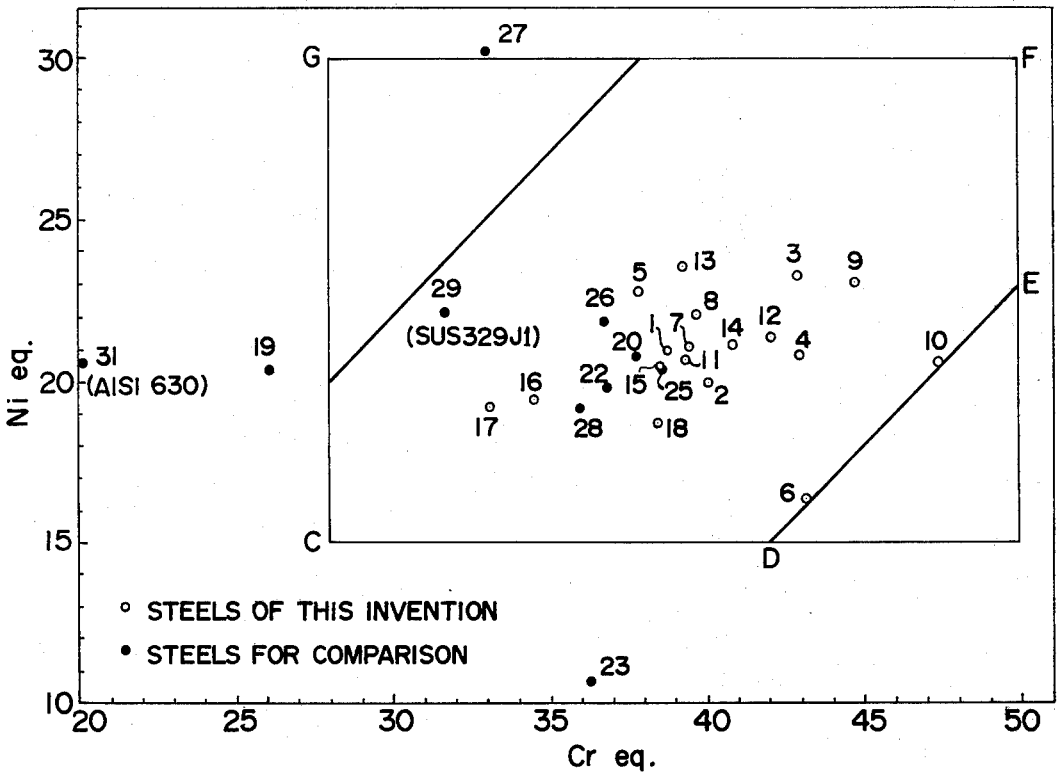
FIG. 1 shows the relationship between chromium equivalent and nickel equivalent of the ferrite-austenite stainless steel according to this invention.

The reasons for specifying the alloy composition of this invention are given below. (The percentages are given by weight.)

Carbon: up to 0.06%

Although carbon is a strong austenitizing element, addition of carbon in a large amount lowers corrosion resistance and hot-workability. Carbon is not therefore allowed to exceed 0.06%, preferably 0.05% particularly when the steel is to be used as a material for a bolt.

Silicon: up to 1.0%

Silicon is a ferrite-forming element which increases oxidation resistance and also acts as a deoxidizing element during smelt refining. However, the addition of this element in excess of 1.0% is not allowed, since it lowers toughness and ductility of the alloy.

Manganese: up to 1.5%

Manganese reacts with sulfur to form manganese sulfides, which prevents the occurence of hot-brittleness, and acts as a deoxidizing element. In addition, as manganese is an austenite former, it should be added up to 1.5% so as to balance the amounts of the phases in the alloy.

Nitrogen: up to 0.10%

Although nitrogen is a strong austenite promoting element, the addition of this element in a large amount tends to lower impact transition temperature. However, the addition of up to 0.1% creats no problem in practice.

Nickel: from 3.0% to 7.0%

Nickel should be contained at least 3.0%, since it is a strong austenite promoting element and improves corrosion resistance. On the other hand, the amounts of nickel, chromium, copper and molybdenum must be balanced in order to obtain a two-phase stainless steel consisting of austenite and ferrite phases. For that reason, the content of nickel should be limited no more than 7.0%.

Chromium: from 21.0% to 28.0%

Chromium is a ferrite-forming element and largely improves corrosion resistance and oxidation resistance of the steel. Since this invention is intended to provide an alloy composed of microduplex structure, the amounts of nickel, chromium, molybdenum and copper must be well balanced. And hence, the chromium contents should be at least 21.0%. On the contrary, the content of chromium should be at most 28.0% from the view point of the need to control the proportion of austenite phase and ferrite phase, cost reduction, and improvement in brittleness.

Copper: up to 3.0%

Copper is an austenite promoting element which strengthens matrix to enhance the strength of the steel. Thus, as the copper content becomes large, the strength of the steel tends to be higher. However, the presence of large amounts of copper lowers the workability and ductility loss of the steel, ad accordingly, this element should be contained at not more than 3.0%, suitably 0.8% to 2%. Within the copper content of up to 3.0%, a lower copper content, particularly that at not more than 0.3%, improves some physicl properties such as upsetting workability, which is an essential property in manufacturing a bolt from the steel.

Molybdenum: from 1.0% to 4.0%

Acid resistance and pitting corrosion resistance of the microduplex stainless steel depend mainly upon the contents of nickel, chromium and molybdenum. Molybdenum should therefore be contained at least 1.0%. On the other hand, molybdenum has a tendency to produce brittleness, and should be contained not in excess of 4.0%.

Boron: from 0.0008% to 0.0080%

Boron should be added at a ratio of at least 0.0008% to enhance corrosion resistance and hot-workabilty. However, the addition of boron in excess of 0.0080% leads to the formation of compounds with low melting point and the tendency to produce brittleness.

Niobium: from 0.08% to 0.7%

Niobium is a ferrite-forming element and fixes carbon and nitrogen on the alloy. In addition, it has grain-refining effect in the alloy and enhances the resistance to grain boundary corrosion, pitting corrosion and sulfuric acid. Further, this metal makes a contribution to improvement in hot-workability and formability of the alloy. Remarkable effects can be obtained when the element is added at the ratio of 0.08 – 0.7%. Niobium may be partly replaced with tantulum.

Tantalum: from 0% to 0.5%

Titanium: from 0% to 0.5%

Zirconium: from 0% to 0.5%

These elements behave in the same manner as niobium, although the effects thereof are inferior to niobium, particularly in pitting corrosion resistance.

Further to the above-mentioned ranges for the incorporation of the respective elements, the composition of the ferrite-austenite stainless steel according to this invention is characterized by the following equations.

Nickel equivalent (hereinafter referred to as Ni eq.) =40 carbon % + nitrogen %) + 3 (nickel %) + (copper %)+ 2(manganese %)

Chromium equivalent (hereinafter referred to as Cr eq.) = (chromium %) + 5.2(silicon %) +4.2 (molybdenum %) + 4.5 (niobium %) +7.0 (titanium %) + 3.0 (tantalum %) +13.0 (zirconium %)

When calculated by these equations, the ferrite-austenite stainless steel of this invention supplies the following relationship:

Ni eq. = from 15 to 30, Cr eq. = from 28 to 50 and Cr eq. - Ni eq. = from 8 to 27.

This relationship is essential for the ferrite-austenite stainless steel of the present invention because the contents of nickel, chromium, copper and molybdenum should be well-balanced to obtain an alloy composed of the desirable microduplex structure.

The stainless steel of this invention is further characterized in that the steel is in the microduplex ferrite-austenite phase caused by a heat solution treatment in which the steel satisfying the above relationship is heated in the temperature range of 1000 ° to 1150 ° C for about 30 minutes per inch of said steel, and then cooled in a suitable manner such as water cooling or oil cooling. The ferrite-austenite stainless steel of this invention thus behaves in quite different manners as steels belonging to the other phases for stainless steel do, the latter being classified in the Shcaeffler diagram into austenite phase, austenite martensite phase, martensite phase, martensite-ferrite phase, austenite-martensite-ferrite phase, and ferrite phase. In addition, the stainless steel of this invention is entirely different from a precipitation hardenable stainless steel prepared by a solution and aging treatment for enhancing the strength of the resultant steel.

The various advantages of the steel of this invention described here in the specification are obtained only by the above heat treatment by which the steel is annealed for developing the solid solution structure of the ferrite-austenite phase. The stainless steel of this invention thus exhibits numerous preferable properties. For example, the steel has 0.2% proof stress of 40 kg/mm$^2$ or more with the least amount of copper contained in the steel, which property makes the steel suitable for various purposes, such as for a material for a bolt.

This invention will be understood more readily with reference to the following example: however, this example is intended to illustrate this invention and is not to be construed as limiting the scope of this invention.

EXAMPLE 1

Mechanical properties, corrosion resistance (JIS GO591) and hot-workability evaluated in torsion number to failure were determined for the samples of the alloy having the compositions as shown in Table 1.

In Table 1, the samples No. 1 to No. 18 are the steels according to the present invention and the samples No. 19 to No. 32 are the alloys given for the purpose of comparison including the commercially available stainless steels where No. 29 is SUS 329 J1, No. 30 is AISI 316, No. 31 is AISI 630 and No. 32 is AISI 304. Samples No. 1 to No. 29 were prepared by heat solution treatment in which each of the alloys having the compositions in the table was maintained at 1080 ° C for 30 minutes followed by rapid cooling. It is added that samples No. 30 (AISI 316) and No. 32 (AISI 304) were heated at 1060 ° C followed by rapid cooling and that sample No. 31 (AISI 630) was heated at 1040 ° C for 30 minutes followed by rapid cooling and thereafter heated at 500 ° C for 4 hours followed by rapid cooling.

TABLE 1

I CORROSION RESISTANCE (5% $H_2SO_4$)(g/m²/Hr)
II HOT WORKABILITY (TORSION NUMBER TO FAILURE)

| SAMPLE No. | COMPOSITION (Wt. %) | | | | | | | | | | | | | | | | | | MECHANICAL PROPERTIES | | | | | |
|---|---|---|---|---|---|---|---|---|---|---|---|---|---|---|---|---|---|---|---|---|---|---|---|---|
| | C | Si | Mn | P | S | N | Ni | Cr | Cu | Mo | B | Nb | Ti | Td | Zr | creq. | Neiq | creq. Neiq | 0.2% P.S. (kg/mm²) | T. S. (kg/mm²) | El (%) | CHU (kg.m/cm²) | I I | II |
| 1 | 0.02 | 0.48 | 0.83 | 0.015 | 0.009 | 0.03 | 5.1 | 22.0 | 2.0 | 3.0 | 0.0015 | 0.38 | — | — | — | 38.8 | 21.0 | 17.8 | 63 | 78 | 31 | 15 | 0.9 | 7.4 |
| 2 | 0.01 | 0.45 | 0.74 | 0.017 | 0.013 | 0.03 | 5.3 | 24.5 | 1.0 | 2.7 | 0.0023 | 0.45 | — | — | — | 40.1 | 20.0 | 20.1 | 62 | 75 | 28 | 20 | 0.8 | 10.5 |
| 3 | 0.02 | 0.38 | 0.85 | 0.015 | 0.008 | 0.02 | 5.0 | 21.5 | 1.7 | 3.7 | 0.025 | 0.30 | 0.35 | — | — | 42.8 | 18.3 | 24.5 | 69 | 78 | 15 | 18 | 1.0 | 13.3 |
| 4 | 0.02 | 0.50 | 0.76 | 0.013 | 0.013 | 0.04 | 5.0 | 21.9 | 2.0 | 4.0 | 0.0217 | 0.36 | — | — | — | 43.0 | 20.9 | 22.1 | 74 | 85 | 26 | 15 | 0.8 | 10.9 |
| 5 | 0.01 | 0.42 | 0.77 | 0.018 | 0.007 | 0.02 | 6.2 | 23.7 | 1.5 | 2.5 | 0.0019 | 0.33 | — | — | — | 37.9 | 22.8 | 15.1 | 63 | 74 | 29 | 19 | 0.7 | 6.1 |
| 6 | 0.01 | 0.52 | 0.64 | 0.016 | 0.014 | 0.02 | 4.2 | 22.3 | 1.3 | 3.8 | 0.021 | 0.48 | — | — | — | 43.2 | 16.4 | 26.8 | 74 | 81 | 22 | 15 | 1.0 | 23.8 |
| 7 | 0.02 | 0.51 | 0.81 | 0.015 | 0.014 | 0.04 | 5.4 | 21.7 | 0.9 | 3.1 | 0.0022 | 0.47 | — | — | — | 39.5 | 21.1 | 18.4 | 59 | 74 | 30 | 20 | 1.3 | 9.1 |
| 8 | 0.03 | 0.42 | 0.75 | 0.020 | 0.006 | 0.03 | 5.5 | 23.3 | 1.5 | 2.8 | 0.0020 | 0.47 | — | 0.20 | — | 39.6 | 21.9 | 17.7 | 67 | 80 | 22 | 20 | 0.9 | 7.6 |
| 9 | 0.03 | 0.53 | 0.86 | 0.013 | 0.015 | 0.03 | 5.7 | 28.5 | 1.9 | 2.8 | 0.0022 | 0.38 | — | — | — | 44.8 | 23.1 | 21.7 | 71 | 82 | 20 | 14 | 0.7 | 12.5 |
| 10 | 0.02 | 0.47 | 0.81 | 0.014 | 0.014 | 0.03 | 5.0 | 21.9 | 2.1 | 5.1 | 0.0012 | 0.36 | — | — | — | 47.4 | 20.7 | 26.7 | 79 | 89 | 25 | 13 | 0.8 | 18.9 |
| 11 | 0.03 | 0.35 | 0.90 | 0.025 | 0.009 | 0.03 | 4.8 | 24.2 | 2.1 | 2.2 | 0.0016 | 0.45 | — | — | 0.15 | 39.2 | 20.7 | 18.5 | 68 | 79 | 25 | 22 | 1.8 | 6.2 |
| 12 | 0.02 | 0.75 | 0.78 | 0.014 | 0.009 | 0.02 | 5.6 | 22.7 | 1.4 | 3.4 | 0.0035 | 0.34 | — | — | — | 42.1 | 21.4 | 20.6 | 63 | 80 | 24 | 17 | 1.2 | 14.4 |
| 13 | 0.03 | 0.45 | 0.82 | 0.017 | 0.009 | 0.04 | 6.0 | 22.1 | 1.2 | 2.9 | 0.0025 | 0.60 | — | — | — | 39.3 | 23.6 | 15.7 | 58 | 76 | 29 | 19 | 0.8 | 8.9 |
| 14 | 0.03 | 0.78 | 0.68 | 0.013 | 0.012 | 0.04 | 5.3 | 23.3 | 1.2 | 3.2 | 0.0076 | 0.33 | — | — | — | 41.9 | 21.3 | 20.6 | 66 | 81 | 21 | 13 | 0.9 | 33.2 |
| 15 | 0.02 | 0.43 | 0.78 | 0.014 | 0.012 | 0.02 | 5.6 | 21.8 | 0.5 | 3.1 | 0.0021 | 0.36 | — | — | — | 38.6 | 20.5 | 18.1 | 55 | 76 | 36 | 21 | 2.3 | 10.2 |
| 16 | 0.04 | 0.35 | 0.60 | 0.013 | 0.010 | 0.02 | 5.5 | 24.8 | 0.16 | 1.5 | 0.0042 | 0.40 | — | — | — | 34.7 | 19.5 | 15.3 | 57 | 68 | 30 | 19 | 1.8 | 22.0 |
| 17 | 0.03 | 0.28 | 0.30 | 0.014 | 0.011 | 0.02 | 5.7 | 25.1 | 0.22 | 1.8 | 0.0021 | 0.42 | — | — | — | 36.0 | 19.1 | 16.9 | 60 | 66 | 26 | 20 | 2.3 | 11.5 |
| 18 | 0.03 | 0.44 | 0.92 | 0.018 | 0.019 | 0.02 | 5.0 | 22.8 | 0.08 | 2.9 | 0.0021 | 0.28 | — | — | — | 38.5 | 18.8 | 19.7 | 49 | 65 | 25 | 23 | 1.9 | 12.1 |
| 19 | 0.02 | 0.56 | 0.54 | 0.016 | 0.014 | 0.03 | 5.1 | 21.6 | 2.0 | — | 0.0022 | — | 0.23 | — | — | 26.1 | 20.4 | 5.7 | 46 | 65 | 37 | 23 | 3.2 | 3.6 |
| 20 | 0.02 | 0.43 | 0.85 | 0.014 | 0.014 | 0.02 | 5.4 | 22.3 | 1.3 | 2.8 | — | 0.34 | — | — | — | 37.8 | 20.8 | 17.0 | 64 | 80 | 24 | 21 | 5.5 | 2.2 |
| 21 | 0.03 | 0.54 | 1.11 | 0.021 | 0.017 | 0.03 | 3.4 | 27.1 | 0.6 | 4.9 | 0.0018 | — | 0.32 | — | — | 52.6 | 15.4 | 37.2 | 72 | 84 | 14 | 2 | — | 28.0 |
| 22 | 0.03 | 0.88 | 0.48 | 0.016 | 0.015 | 0.05 | 4.9 | 17.4 | 1.0 | 3.2 | 0.0016 | 0.32 | — | — | — | 36.9 | 19.9 | 17.0 | 61 | 79 | 33 | 17 | 3.7 | 6.7 |
| 23 | 0.03 | 0.33 | 0.31 | 0.017 | 0.012 | 0.03 | 2.2 | 22.0 | 1.2 | 2.7 | 0.0028 | 0.31 | — | — | — | 36.5 | 10.8 | 25.7 | 73 | 86 | 17 | 2 | 12.2 | 25.0 |
| 25 | 0.02 | 0.41 | 0.72 | 0.014 | 0.017 | 0.04 | 5.1 | 23.6 | 1.2 | 3.1 | 0.0020 | — | — | — | — | 38.7 | 20.3 | 18.4 | 61 | 71 | 41 | 27 | 8.5 | 5.2 |
| 26 | 0.03 | 0.56 | 1.39 | 0.019 | 0.013 | 0.04 | 5.4 | 22.8 | — | 1.9 | — | — | 0.35 | — | 0.05 | 36.8 | 21.9 | 14.9 | 51 | 65 | 40 | 29 | 4.0 | 3.5 |
| 27 | 0.09 | 0.28 | 0.52 | 0.011 | 0.019 | 0.08 | 6.8 | 21.2 | 2.0 | 2.2 | 0.0026 | 0.24 | — | — | — | 33.0 | 30.2 | 2.8 | 33 | 58 | 60 | 35 | 15.3 | 1.0 |
| 28 | 0.04 | 0.40 | 0.40 | 0.015 | 0.018 | 0.05 | 5.6 | 25.3 | 0.11 | 2.1 | 0.0025 | — | — | — | — | 36.2 | 19.3 | 16.9 | 59 | 65 | 29 | 24 | 6.0 | 9.8 |
| 29 | 0.05 | 0.46 | 0.97 | 0.017 | 0.015 | 0.03 | 5.7 | 24.3 | — | 1.2 | — | — | — | — | — | 31.7 | 22.2 | 9.5 | 47 | 66 | 38 | 28 | 4.8 | 2.0 |
| 30 | 0.06 | 0.30 | 1.00 | 0.015 | 0.021 | 0.03 | 10.8 | 17.2 | — | 2.5 | — | — | — | — | — | 29.1 | 41.1 | −12.0 | 29 | 65 | 56 | 30 | 9.5 | — |
| 31 | 0.05 | 0.35 | 0.45 | 0.012 | 0.019 | 0.03 | 4.1 | 16.9 | 4.2 | — | — | 0.31 | — | — | — | 20.1 | 20.6 | −0.5 | 123 | 134 | 14 | 7 | 262.0 | — |
| 32 | 0.05 | 0.50 | 1.20 | 0.015 | 0.015 | 0.05 | 9.0 | 18.3 | 0.09 | — | — | — | — | — | — | 20.9 | 33.5 | −12.6 | 28 | 64 | 58 | 32 | 89.0 | — |

The results were, as shown in Table 1, that all stainless steels according to this invention have 0.2% proof stress higher than approximately 50 kg/mm².

It is clearly noted that the steel according to this invention is superior to SUS 329 J1 in mechanical properties, corrosion resistance and hot-workability. The ferrite-austenite steel of this invention is evidently has better corrosion resistance and hot-workability than the conventional austenite stainless steel AISI 316.

FIG. 1 shows the relationship between Cr eq. and Ni eq. of the steels according to this invention which are listed in Table 1. The desirable characteristics of the steel according to this invention can be obtained by causing the steel to be composed of austenite phase and ferrite phase. This can be achieved when Ni eq. and Cr eq. are present in or on the lines bounding the area GCDEFG shown in FIG. 1. Any steel whose composition falls outside this range does not possess the desired properties to which this invention is directed, because of, for example, the occurence of single ferrite phase.

Figure 2:
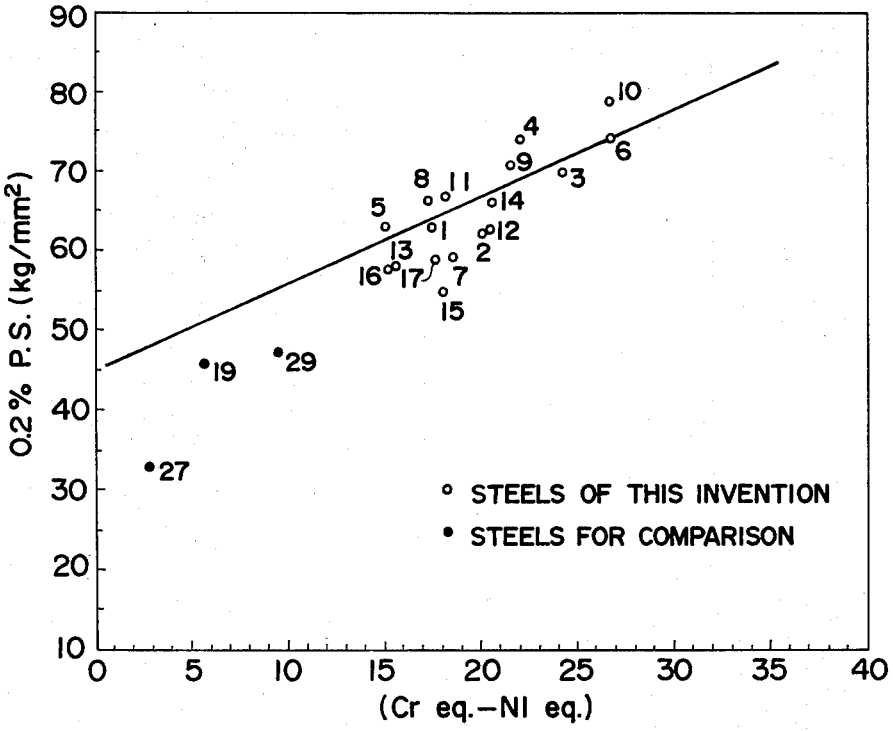
FIG. 2 gives the relationship between 0.2% proof stress values and the values of the subtraction of the nickel equivalent from the chromium equivalent of the steel according to this invention.

FIG. 2 gives the relationship between 0.2% proof stress values and (Cr eq. - Ni eq.) values of the steels according to this invention. It is understood that the 0.2% proof stress of the steel according to this invention increases for higher values of (Cr eq. - Ni eq.) with the high minimum value of approx. 40 kg/mm². On the other hand, it is not preferred that the value (Cr eq. - Ni eq.) be over 27 since the toughness and ductility is reduced due to the formation of single ferrite phase.

Figure 3:
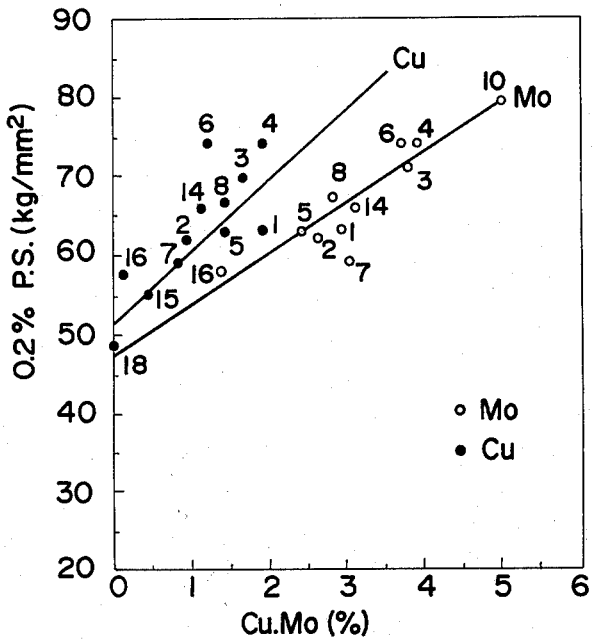
FIG. 3 is to show the variations in 0.2% proof stress against the copper and molybdenum contents of the steel according to this invention.

According to this invention, relatively large amounts of molybdenum and copper are added for enhancing 0.2% proof stress. Molybdenum enhances the 0.2% proof stress not only by increasing the value (Cr eq. - Ni eq.) but by strengthening the matrix. Copper leads to the lowerness of 0.2% proof stress due to the decrease of (Cr eq. - Ni eq.) value, but it also enhances 0.2% proof stress by strengthening the matrix. The latter function excels the former, and as a result copper contributes to improvement in 0.2% proof stress, which is shown by FIG. 3.

Figure 4:
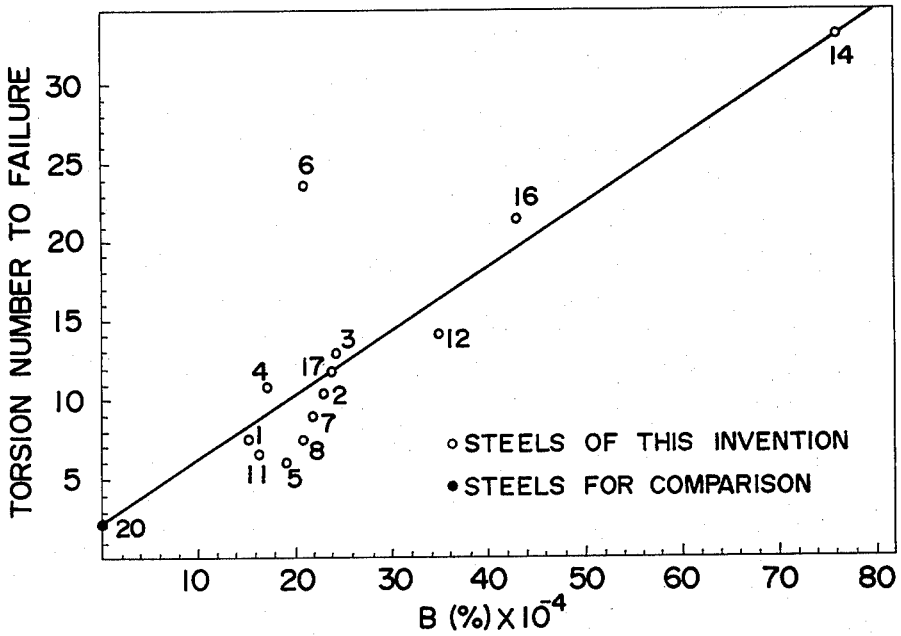
FIG. 4 is to give the relationship between hot-workability and boron contents of the steel according to this invention.

The steel according to this invention has excellent hot-workability. This is due to the addition of boron in addition to the increase of the value (cr eq. - Ni eq.) as shown in FIG. 4. FIG. 4 is to indicate the relationship between the boron contents and the hot-workabilities of the steels according to this invention, the latter being expressed in torsion number to failure at 1150 ° C. It is apparent from FIG. 4 that the hot-workability increases with increasing the content of boron.

From the above example, it is understood that the stainless steel according to this invention has high proof stress, at least 40 kg/mm² or more expressed as 0.2% proof stress value, improved corrosion resistance as is equal to or rather superior to AISI 316, and enhanced corrosion resistance and hot-workability as good as or much better than SUS 329 J1, by specifying the ranges of the contents of the alloy elements, Cr eq., Ni eq., and (Cr eq. - Ni eq.).

Thus, the ferrite-austenite stainless steel according to this invention is particularly suitable for use in fabrication of body of a centrifugal separator.

As the copper content becomes small, the stainless steel of the invention tends to be lower in its proof stress. However, with the least content of copper, the ferrite-austenite stainless steel of this invention posseses 0.2% proof stress of at least 40 kg/mm² or more. and, particularly when the copper content becomes 0.3% or less, develops some significant properties which make the steel suitable for use as a material for a bolt. This will clearly be understood by the example below.

EXAMPLE 2

The samples of the steels, whose compositions are shown in Example 1 (No. 16, 17, 28, 30 and 32), were subjected to further tests for mechanical properties, with the results summarized in Table 2. Each of the samples was shaped 30 mm in diameter and was subjected to heat solution treatment at 1080 ° C for 30 minutes followed by water cooling.

Table 2

| Sample No. | I | II | III | IV | V |
|---|---|---|---|---|---|
| No. 32 (AISI 304) | 21 | 13.8 | 5.5 | ≤ 1.1 | 160 |
| No. 30 (AISI 316) | 20 | 6.5 | 3.7 | ≤ 1.1 | 162 |
| No. 28 | — | 9.5 | > 200 | ferromagnetic | 124 |
| No. 16 (This Invention) | 39 | 3.6 | >240 | ferromagnetic | 127 |
| No. 17 (This Invention) | 38 | 2.8 | >240 | ferromagnetic | 121 |

I: Fatigue strength when subjected to rotating bending fatigue test (kg/mm²).

II: Loss in weight of a sample, 18mm(d) x 20mm(l), due to pitting corrosion when immersed in solution containing 50 g $FeCl_3 \cdot 6H_2O$ per $1^l$ $H_2O$ ($g/m^2 \cdot hr$) at 35° C.

III: Time required to rupture in 42% boiling $MgCl_2$ solution under the load of 15 kg/mm² (hour).

IV: Permeability, magnetizing field H = 200 Oe.

V: Resistance to upsetting deformation with compressive strain $\xi$ (= ln ($h_0$/h)) = 1.0, in which $h_0$ and h respectively designate the heights before and after the upsetting.

The steels were further formed into bolts and were subjected to the hot salt spray corrosion test specified as JIS Z2371-1955. The results are summarized in Table 3.

Table 3

| | Size, mm (Diameter × Length of shank) | Head, top surface | Head, side surface | Screw portion |
|---|---|---|---|---|
| No. 32 (AISI 304) | M8 × 30 | Stain | Stain | Stain |
| No. 30 (AISI 316) | M8 × 30 | No stain | Stain (slightly) | Stain (slightly) |
| No. 28 | M6 × 50 | Stain (slightly) | No stain | Stain (slightly) |
| No. 16 (This Invention) | M6 × 50 | No stain | No stain | No stain |
| No. 17 (This Invention) | M6 × 50 | No stain | No stain | No stain |

Testing Conditions:
Salt solution: 5 ± 1% NaCl
Temperature of the solution: 35 ° C
pH of the solution: 6.5 – 7.2
Air feed pressure: 0.7 – 1.8 kg/cm²
Room temperature when tested: 25 ° ± 2 ° C
Rate of spray concentration: 0.5 – 3.0 ml/80cm²/hr.
Spraying period: Actual spraying 8 hr. Cease 16 hr.
Total spraying period : 150 hr.

Figure 8:
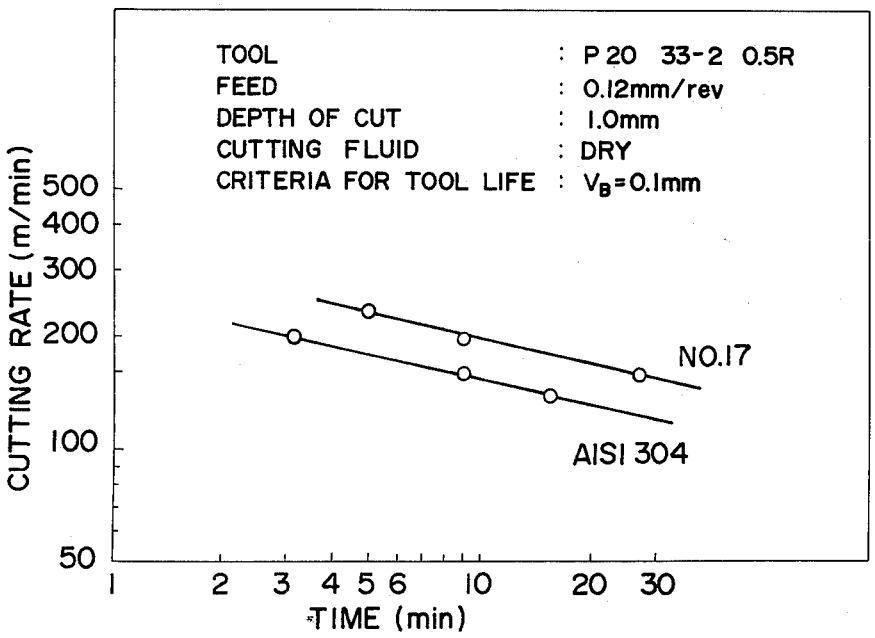
FIG. 8 is to show machinability of the steel of this invention in comparison with conventional AISI 304 steel.

Furthermore, the steel of this invention (Sample No. 17) was subjected to a machinability test in comparison with the conventional steel No. 32 (AISI 304). The results are shown in FIG. 8.

From the results given in the above, it is clear that the steel of this invention is suitable for use as a material for a bolt. The steel of this invention shows high mechanical strength, namely, almost twice as high as the conventional AISI 304 or AISI 316 in 0.2% proof stress and fatigue strength. A bolt made of the stainless steel has high clamping force to increase resistance against vibration during operation. The stainless steel of this invention is further advantageous for manufacturing a bolt in that it has excellent workability, not only in hot workability but in cold upsetting workability and even in machinability. Because of high machinability of the stainless steel of the invention, tool life in manufacturing a bolt therefrom can be lengthened to almost ten times that possible with conventional AISI 316, as seen from FIG. 8. In addition, since the steel according to this invention is ferromagnetic, bolts made of this steel, even when they are damaged, can be easily removed by the application of magnetic attractive force, which properties enable the polution of food to be prevented when the bolt is used in food-making plants.

Furthermore, the tables 2 and 3 shows that the steel of the present invention has excellent corrosion resistance, not only for general corrosion but also for pitting corrosion.

Because of the numerous advantages stated above, the stainless steel is suitable as a material for a bolt for application in such devices as food-making plants, sea water pumps, or acetic acid carrying pumps.

These favorable properties are caused by specifying each of the constitunal elements and further Ni eq. and Cr eq. as claimed in the claims, particularly with respect to copper content and employment of niobium, as will be more easily understood from the following explanation with reference to the attached drawings showing the relationship of the amounts incorporated thereof and some physical properties.

Figure 5:
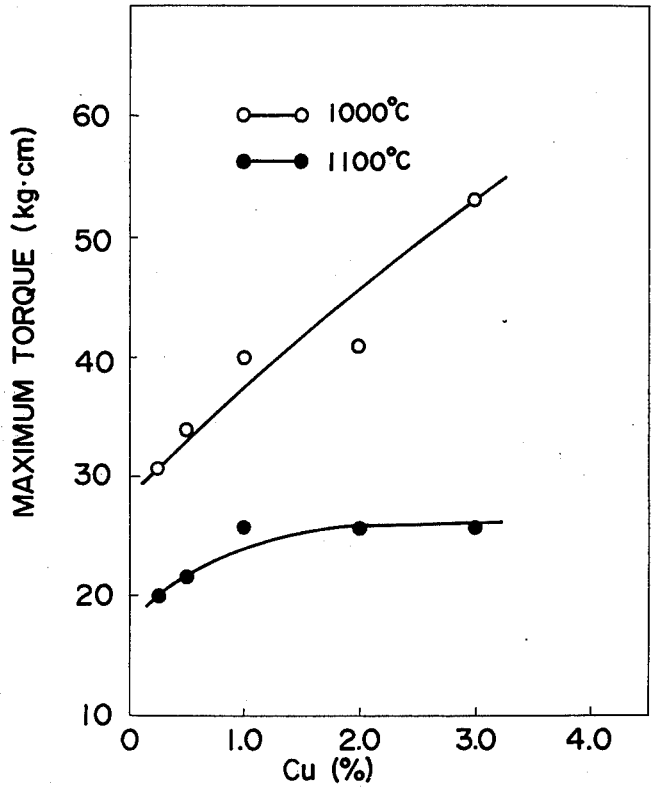
FIG. 5 shows the variations in maximum torque against the copper contents of the steel of this invention.
Figure 6:
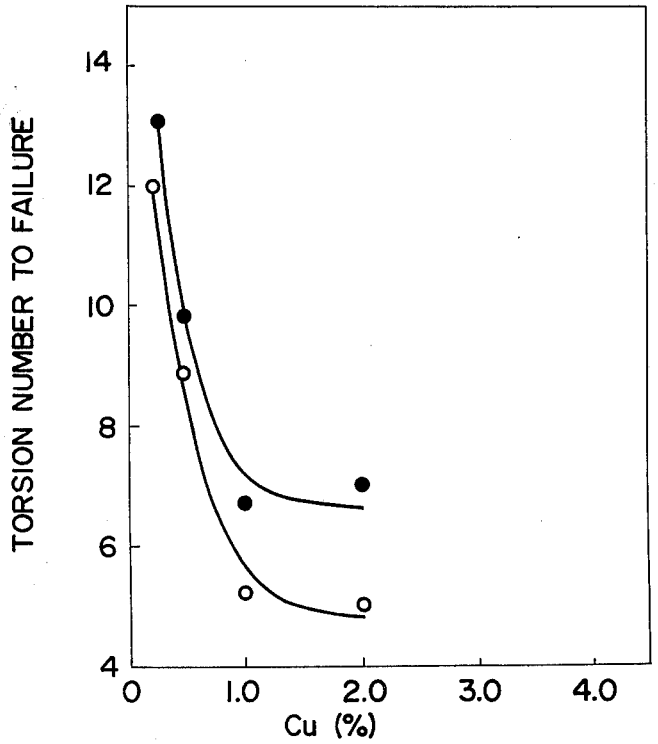
FIG. 6 shows the variations in torsion number to failure against the copper contents of the steel of this invention.

FIG. 5 and FIG. 6 respectively show the variations in maximum torque and torsion number to failure against the copper contents of the steels of this invention, in which the properties of the elements incorporated other than copper for each of the steels are : carbon 0.04%, silicon 0.35%, manganese 0.70%, nickel 4.9%, chromium 24.8%, molybdenum 2.3%, niobium 0.41% and boron 0.0026%. It is understood from FIG. 5 that the values of maximum torque increase with increasing the copper contents in which lower test temperature makes the value higher. FIG. 6 shows that torsion number to failure rapidly increases as copper content increases up to approx. 1.0% and thereafter almost no particular effects can be observed with increasing copper content. Maximum torque and torsion number to failure are good criteria for cracking resistance and energy to be supplied when the steel is rolled for manufacturing wire rods or when the steel is cold worked for forming the same into bolts. It is noted from these figures that the steel of a lower copper content is better for steadily manufacturing wire rods or bolts therefrom because of less energy and high torsion number. Taking the amount of copper to be contained as an inevitable impurity into consideration, the preferred upper limit of copper content is 0.3%.

Figure 7:
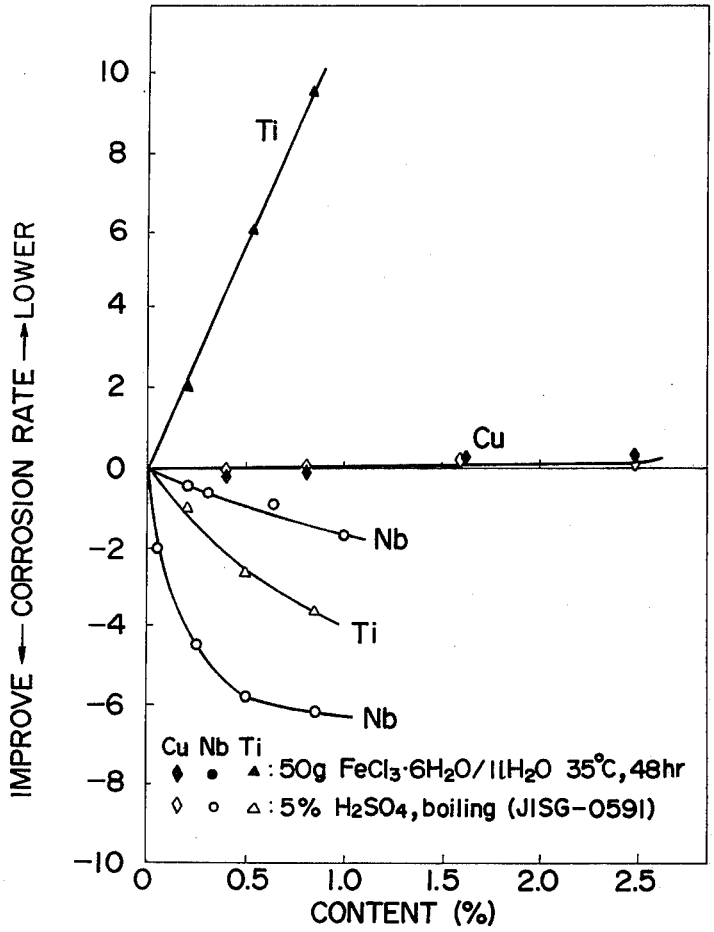
FIG. 7 is to show the effects of niobium, titanium and copper contents on corrsosion resistance of the steel of this invention.

FIG. 7 is to show the effects of niobium, titanium and copper contents on the corrosion resistance of the steel in which the proportions of the elements incorporated other than the elements given in the figure are for each of the steels : Carbon 0.04%, silicon 0.31%, manganese 0.66%, nickel 6.1%, chromium 24.7%, molybdenum 1.8%, and boron 0.021%. The tests by varying the niobium contents were carried out on the steel containing the respective elements in the above-mentioned proportions and 0.10% copper and no titanium. The tests on the variation in the titanium contents were conducted with the steel having above-mentioned proportions for the respective elements and containing 0.10% copper and no niobium. Further, the tests were carried out by varying the copper contents on the steels having the above-mentioned proportions for the elements and containing neither niobium nor titanium. It is understood from this figure that addition of niobium the most effectively improves the total surface corrosion resistance of the steel, which is determined with the boiling solution containing 5% sulfuric acid, while the niobium content exceeding 0.7% does not produce any particular effects. It should be noted that although titanium behaves in the same manner with less degrees as niobium for improving the total surface corrosion resistance of the steel, which is expressed in terms of corrosion resistance to the boiling 5% sulfuric acid, titanium adversely affects the pitting corrosion resistance determined with an aqueous solution of ferric chloride. This is in contrast to the fact that niobium plays a positive part in improving both total surface corrosion and pitting corrosion resistances. The figure further shows that copper does not any particular effect on the improvement of corrosion resistance of the steel. Thus, in view of the adverse affect on the workability of the steel as previously stated, the less is copper content, the better is the resultant steel. For obtaining positive effects particularly on the corrosion resistance, niobium should be contained in the steel in the proportion of at least 0.20%, while an addition exceeding 0.70% is not preferred from the view points of the cleanness and the formability of the steel and further economical reasons.

What is claimed is:

1. An improved stainless steel in ferrite-austenite condition said ferrite-austenite condition being produced by solution heat treatment at a temperature of 1000 ° –1150 ° C, and composed of, by weight percent, carbon up to 0.06%, silicon up to 1.0%, manganese up to 1.5%, nickel from 3.0% to 7.0%, chromium from 21.0% to 28.0%, copper up to 3.0%, molybdenum from 1.0% to 4.0%, boron from 0.0008% to 0.0080%, niobium from 0.08% to 0.7%, titanium from 0% to 0.5%, tantalum from 0% to 0.5%, zirconium from 0% to 0.5%, nitrogen up to 0.1%, and the remainder of iron and an inevitable amounts of impurity, with the values of nickel equivalent and chromium equivalent calculated by the following equations:

nickel equivalent = 40 (carbon % + nitrogen %) +3 (nickel %) + (copper %) +2 (manganese %)

chromium equivalent = (chromium %) + 5.2 (silicon %) +4.2 (molybdenum %) + 4.5 (niobium %) +7.0 (titanium %) + 3.0 (tantalum %) +13.0 (zirconium %)

satisfying the relationship below:

nickel equivalent = from 15 to 30 chromium equivalent = from 28 to 50 chromium equivalent — nickel equivalent = from 8 to 27.

2. The improved steel of claim 1 having a copper content of up to 0.3%.

3. An improved stainless steel in ferrite-austenite condition, said ferrite-austenite condition being produced by solution heat treatment at a temperature of 1000 ° –1150 ° C, and composed of, by weight percent, carbon up to 0.06%, silicon up to 1.0%, manganese up to 1.5%, nickel from 3.0% to 7.0%, chromium from 21.0% to 28.0%, copper from 0.8% to 2.0%, molybdenum from 1.0% to 4.0%, boron from 0.0008% to 0.0080%, niobium from 0.08% to 0.7%, titanium from 0% to 0.5%, tantalum from 0% to 0.5%, zirconium from 0% to 0.5%, nitrogen up to 0.1%, and the remainder of iron and an inevitable amounts of impurity, with the values of nickel equivalent and chromium equivalent calculated by the following equations:

nickel equivalent = 40 (carbon % + nitrogen %) +3 (nickel %) + (copper %) +2 (manganese %)

chromium equivalent = (chromium %) + 5.2 silicon %) +4.2 (molybdenum %) + 4.5 (niobium %) +7.0 (titanium %) + 3.0 (tantalum %) +13.0 (zirconium %)

satisfying the relationship below:

nickel equivalent = from 15 to 30
chromium equivalent = from 28 to 50
chromium equivalent — nickel equivalent = from 8 to 27.

* * * * *